US005692916A

United States Patent [19]

Halasz

[11] Patent Number: 5,692,916

[45] Date of Patent: Dec. 2, 1997

[54] SHUNTING SWITCH

[75] Inventor: Gerald P. Halasz, Shelton, Conn.

[73] Assignee: Framatome Connectors USA Inc., Norwalk, Conn.

[21] Appl. No.: 675,724

[22] Filed: Jul. 3, 1996

[51] Int. Cl.[6] ..... H01R 13/703

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 3,771,102 | 11/1973 | Murray et al. | 339/19 |
| 4,070,557 | 1/1978 | Ostapovitch | 200/51.1 |
| 4,089,577 | 5/1978 | Pechard et al. | 200/51.1 |
| 4,179,173 | 12/1979 | Rise, III | 339/19 |
| 4,283,100 | 8/1981 | Griffin et al. | 339/222 |
| 4,514,030 | 4/1985 | Triner et al. | 339/176 |
| 4,798,542 | 1/1989 | Asick et al. | 439/188 |
| 4,895,532 | 1/1990 | Bogese, II | 439/507 |
| 4,988,307 | 1/1991 | Muzslay | 439/188 |
| 5,112,238 | 5/1992 | Cizin | 439/188 |
| 5,263,872 | 11/1993 | Marpoe, Jr. et al. | 439/188 |
| 5,266,043 | 11/1993 | Giroux et al. | 439/188 |
| 5,277,606 | 1/1994 | Giroux et al. | 439/188 |
| 5,374,200 | 12/1994 | Giroux | 439/188 |
| 5,391,087 | 2/1995 | Fukuda | 439/188 |
| 5,409,387 | 4/1995 | Northey et al. | 439/188 |
| 5,449,301 | 9/1995 | Hanna et al. | 439/510 |
| 5,456,619 | 10/1995 | Belopolsky et al. | 439/620 |
| 5,470,243 | 11/1995 | Bendorf | 439/188 |

*Primary Examiner*—P. Austin Bradley
*Attorney, Agent, or Firm*—Perman & Green, LLP

[57] ABSTRACT

A shunting switch used in an electrical connector is formed as a bifurcated element having contact edges which are compressed between the lateral side edges of a pair of contact pins when the switch is closed. The contact edges of the shunting switch as each moves upwardly from an open condition to a closed condition occurs when the mating connector is removed causing a wiping action of the surfaces of the pins.

20 Claims, 2 Drawing Sheets

SHUNTING SWITCH

The present invention relates to a shunting switch used in an electrical connector of the type having a plurality of contact pins disposed in a row therein, and relates more particularly to improvements in such shunting switches wherein the switches are provided with contact surfaces which act not only to effect an electrical connection with contact pins but further allow relative linear movement between the contact surfaces to effect wiping of the pins so as to minimize buildup of debris thereon.

Contact switches having a bifurcated form are known in the art. One such bifurcated form of a shunting switch is found in U.S. Pat. No. 5,470,243 issued to Bendorf on Nov. 28, 1995. In this patent it is disclosed to provide a shorting switch having bifurcated contact ends that are spaced the same distance as the spacing of the contact pins in the row adjacent the sidewall of the connector. In this way the bifurcated contact end assures a substantially equal contact force when the contact ends are in engagement with the two pin contacts exposed adjacent to them. However, the contact pins of the bifurcated shunting switch act only at distinct points on each of the pin contacts. Thus there is no relative linear movement of switch ends along the length of the contact pins. Likewise in the U.S. Pat. No. 4,070,557 issued to Ostapovitch on Jan. 24, 1978, a bridging contact member is disclosed which includes two spaced apart bridging terminals which engage contact pins disposed immediately in front on the terminal ends. Again, this contact construction provides only single point co-action between the contact tips and the elongated pin members.

Accordingly it is the object of the invention to provide a shunting switch in an electrical connector of the type of having a plurality of contact pins which are arranged in a row and which shunting switch is capable of moving linearly relative to the elongated dimension of the contact pins to effect wiping of the surface of the pins.

Still a further object of the invention is to provide a shunting switch of the aforementioned type whereby the switch is provided with sufficient normal force against the transverse side of the contact pins to ensure proper electrical performance.

Still a further object of the invention is to provide a shunting switch of the aforesaid type which can be made cost effectively.

Other objects and advantages of the invention will become apparent from the following specification and the appended claims.

SUMMARY OF THE INVENTION

The present invention resides in an electrical connector of the type having a housing and a base defining a receptacle for receiving a mating connector therein. The connector further includes a plurality of contact pins arranged on the base such that a pair of the contact pins define surfaces which oppose one another. At least one shunting switch is provided and is associated with a pair of the contact pins. The at least one shunting switch is bifurcated to define two contact surfaces each respectively disposed along lateral sides of the switch and contacting one of the contact pin opposing surfaces and being laterally deflectable upon engagement with the opposing surfaces of the contact pin pair.

DETAILED DESCRIPTION OF THE PREFERRED EMBODIMENT

Figure 1:
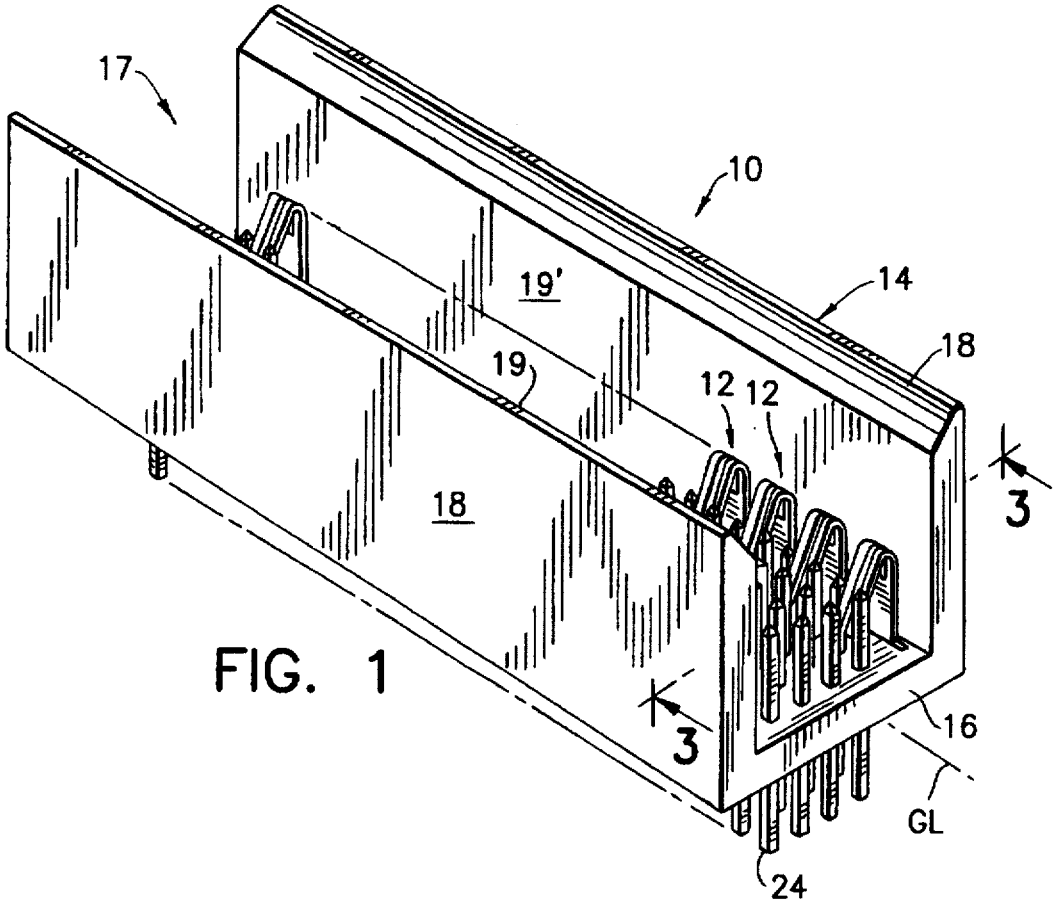
FIG. 1 is a perspective view of the electrical connector and the shunting switches embodying the present invention.

Referring to FIG. 1, there is shown a perspective view of an electrical connector 10 incorporating shunting switches 12, 12 of the present invention. Although the present invention will be described with reference to the single embodiment shown in the drawings, it should nevertheless be understood that features of the present invention could be embodied in many different forms of alternate embodiments. In addition, any suitable size, shape or type of elements or materials could be used.

The connector 10 generally comprises an elongate housing 14 defined by a base 16 and two integrally connected parallel sidewalls 18, 18 disposed substantially symmetrically about a centerline CL. Each side wall has an opposed inwardly directed face 19, 19' which together with the upper surface of the base 16 defines a generally channel-like receptacle 17 for receiving a mating connector (not shown) therein. As is typical in the industry, the housing 14 is formed from a dielectric material as is the housing of the mating connector.

The connector 10 also includes a plurality of contact pins 20, 20 each arranged in rows 22A, 22B, 22C and 22D extending lengthwise of the connector and parallel to the sidewalls 14,14. Each of the contact pins has an upper portion 23 which extends upwardly into the receptacle 17 to engage corresponding positioned contacts in the mating connector when the mating connector is inserted therein. Also, each of the contact pins 20, 20 has a lower portion 24 which fixedly extends through the base 16 and depends therefrom to serve as a lead in electrical engagement with selected circuitry on a circuit board to which the connector 10 is connected.

Figure 2:
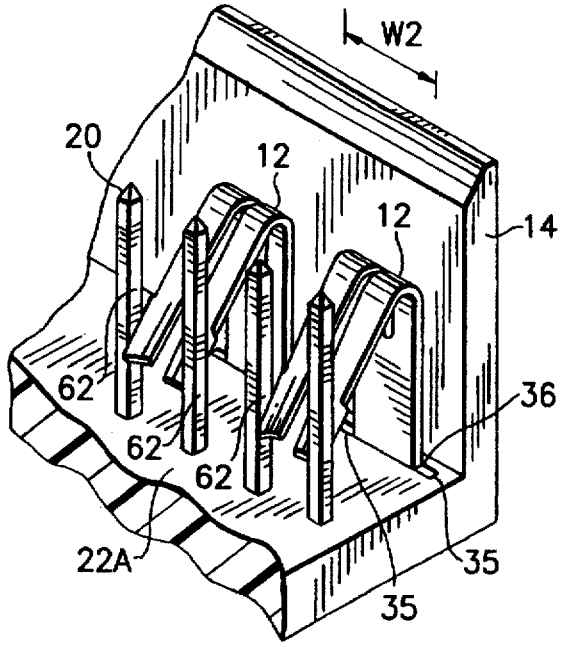
FIG. 2 is a partially fragmentary perspective view of the shunting switches in the closed condition with the juxtaposed pair of contact pins.
Figure 3:
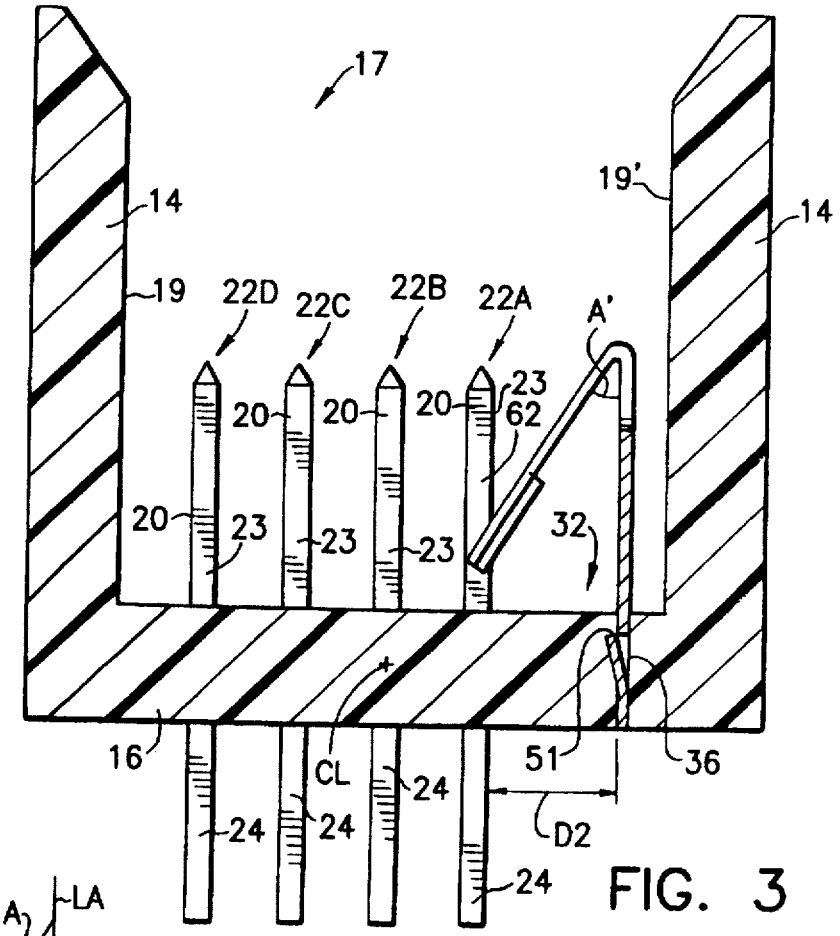
FIG. 3 is a sectional view taken along line 3—3 of FIG. 1.

As illustrated in FIGS. 1 and 2, each of the contact pins 20, 20 of row 22A is equidistantly spaced from the other pins in the same row in the direction of the centerline CL. The successively ordered rows 22A–22B, 22B–22C, 22C–22D, as well as the pins making up these rows, may likewise be equidistantly spaced from one another and so as to create a matrix of pin elements defining rows and columns which extend along the base 16 of the receptacle 15 of the connector 10. As best illustrated in FIG. 3, this matrix of rows and columns of the pins 20 is laterally offset from the centerline CL of the connector 10 so as to provide a space 32 between the inner face 19' of the connector and the first row 22A of the contact pins. Within this space 32 are located the shunting switches 12 of the present invention.

Figure 4:
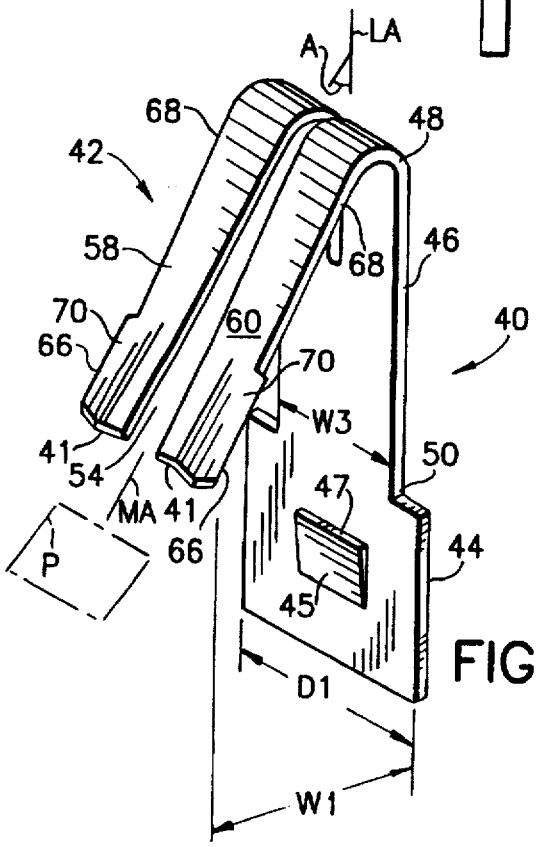
FIG. 4 is a perspective view showing the shunting switch apart from the connector.

Each shunting switch 12 is mounted within the base 16 in a receiving slot 36 correspondingly sized and shaped to mechanically anchor the shunting switch 12 securely into the base 16. As illustrated in FIG. 4, each shunting switch 12 has a major portion 40 extending generally symmetrically about a major axis LA and a minor portion 42 which is integrally formed with the major portion 44 and disposed symmetrically about a minor axis MA. In the relaxed condition of the switch as shown in FIG. 4, the major and minor axes LA and MA intersect at an angle A, which in the preferred embodiment is equal to between 30 and 40 degrees. Also, in the illustrated relaxed condition of FIG. 4, the free end 41 of the switch extends a distance D1 taken perpendicularly from the major axis LA.

The major portion 40 of the switch 12 is defined by a mounting base 44 having a width W1 and an integrally connected elongated body portion 46 extending upwardly from the mounting base 44 and terminating in a generally U-shaped bent portion 48 connecting the major and minor portions of the shunting switch to one another. The slot 36 has a width W2 defined by endwalls 35,35 which extend perpendicularly to the central axis CA of the connector. The dimension W2 is only slightly longer than the width W1 of the mounting base 44 so as to maintain the mounting base 44 of the switch 12 in alignment with the contact pin pair associated with it. That is, the endwalls 35,35 of each slot are also disposed substantially coincidentally with one contact pin of the pair of contact pins which are located immediately adjacent it.

As illustrated, the body 42 of the switch 12 has a width W3 which is substantially smaller in dimension than the width W1 of the mounting base 44 so as to form a stepped shoulder 50 along the lateral sides of the major portion 40 perpendicularly to the major axis LA. Also, the mounting base 44 includes a detent 45 which is a laterally deflectable portion of the sheet metal from which the switch is made. As shown in FIG. 3, cooperating with the detent 45 is an inwardly directed stop shoulder 51 formed in the receiving slot 36. The detent provides a stop surface 47 for cooperating against the stop shoulder 51 to mechanically secure the switch to the connector. The detent 45 yeildably tapers outwardly to its leading edge 47 so as to snap in place behind the shoulder 51 as the switch is inserted downwardly into the slot 36. In this way, each slot 36 immovably connects the shunting switch 12 to the connector against upward movement because of the detent 45 and shoulder 51 arrangement, and against wobbling movement through the close dimensioning of the slot 36 relative to the mounting base 44 of the switch.

Referring now to FIG. 4, it should be seen that a generally V-shaped slot 54 is formed in the minor portion 42 of the switch 12 opening at the free-end 41 thereof and extending longitudinally therealong symmetrically about the minor axis MA. The slot 54 also extends through the generally U-shaped bent portion 48 of the switch and partially into the body 46 of the major portion 40. The slot 54 thus divides the minor portion 40 of the switch 12 into two contact parts 58 and 60, each respectively responsible for engaging the inner surfaces 62,62 of the pins 20,20 of the row 22A. For this purpose, the first and second contact parts 58 and 60 include folded portions extending transversely of the minor axis MA and exteriorly of the lateral side edges thereof. A portion of each of the first and second contact parts 58 and 60 taken from points T, T and forwardly toward the free end 41 of each contact part is thus bent downwardly out of the illustrated plane P to create contact edges 66,66 which are responsible for contacting the side or inner surface 62 of an associated one of the pins 20,20. The contact edges 66,66 are disposed laterally outwardly of the remaining edge portion 68,68 of the contact parts 58 and 60 so as to be compressibly disposed between consecutively ordered ones of the pins 20,20 in the row 22A when in the closed condition.

Each contact edge 66,66 is connected to its associated contact part 58 and 60 through a contact surface 70 which is bent out of the plane P. The surfaces 70,70 serve to cam the first and second contact parts 58 and 60 inwardly between the opposed pairs of contact pins 20,20 when the mating connector is removed from the receptacle 17. That is, because the mounting base 44 of each switch is secured to the connector 10 at a distance D2 from the row 22A, the minor portion 40 and the major portion 42 of the switch are caused to assume an angle A' which is of a dimension smaller than the angle A representing the relaxed condition of the switch as seen in FIG. 4. This is because the dimension D2 is shorter than the relaxed extension dimension D1 thereby causing the contact pins 20 to impinge upon the otherwise extended free end ares of the contact parts 58 and 60.

Thus, in the illustrated closed condition of the switch, the contact edges 66 engage with the inner surfaces 62,62 of the mounting pins 20,20. But before this happens, it should be understood that the contact parts 58 and 60 are first deflected towards the pins 20,20 from an otherwise nonengagening condition when the mating connector is withdrawn from the receptacle 17. In so doing, the contact edges 66,66 of the contact parts 58 and 60 are caused to move upwardly along the inner surfaces 62, 62 until the compression force caused by the action of these surfaces stops the upward movement of the first and second contact parts 58 and 60 and thereby maintains the shorted switch condition illustrated in each of FIGS. 1 through 3. Through this action, the contact edges 66,66 wipe localized areas of the inner surfaces 62, 62 of the contact pins 20,20 thus enhancing electrical contact therebetween.

By the foregoing, an improved shunting switch has been disclosed by way of the preferred embodiment. However, numerous modifications and substitutions may be made without departing from the spirit of the invention. For example, while in the illustrated embodiment the shunting switch is shown disposed between two consecutively ordered contact pins, it is well within the purview of the invention to provide a switch which employs bifurcated contact parts which are spaced so as to coact against contact pins which are not consecutively ordered.

Accordingly, the invention has been described by way of illustration rather than limitation.

I claim:

1. An electrical connector comprising:

a housing having a base;

a plurality of contact pins arranged on said base such that a pair of said contact pins define surfaces which oppose one another;

at least one shunting switch associated with a pair of said contact pins;

and wherein said at least one shunting switch is bifurcated to define two contact surfaces each respectively disposed along lateral sides of said switch and contacting one of said contact pin opposing surfaces and being laterally deflectable upon engagement with said opposing surfaces.

2. A connector as defined in claim 1 wherein said contact surfaces are formed respectively on first and second contact parts, said first and second contact parts being bifurcated by a generally V-shaped slot opening laterally outwardly toward a free end of the shunting switch which is associated with the contact pins.

3. A connector as defined in claim 2 wherein said shunting switch includes a major portion and a minor portion with said major portion including a mounting base and a body integrally connected with one another.

4. A connector as defined in claim 3 wherein said mounting base having a first given width and said body having a second given width so as to create a shoulder between the body and the mounting base of said connector.

5. A connector as defined in claim 4 further characterized in that said V-shaped slot creates said first and second contact parts in said connector; and wherein each of said first and second contacting parts including a bent contact surface bent out of the plane which includes the remaining length of said first and second contact parts.

6. A connector as defined in claim 5 further characterized in that said first and second contacting parts make up the minor portion of said at least one shunting switch and said mounting base and said elongated body make up the major portion of said shunting switch and each of said major and minor portions being integrally connected to one another by a U-shaped interconnecting portion.

7. A connector as defined in claim 5 further characterized in that said first and second contacting parts defining a free end of said at least one shunting switch and ending at a first distance therefrom and being disposed at given angle when said major and minor portions are in a relaxed condition.

8. A connector as defined in claim 7 wherein said shunting switch is mounted to said housing at a second given distance measured to the involved pair of contact pins, and which second given distance being less than said first given distance.

9. A connector as defined in claim 8 further characterized in that said mounting base includes a deflectable detent which extends laterally outwardly from a transverse side of said mounting base in a tapered manner so as to create a stop surface at the free end thereof.

10. A connector as defined in claim 9 further characterized in that said housing includes a base in which is formed a receiving slot correspondingly sized and shaped to receive said mounting base of said at least one shunting switch therein, said receiving slot including a stop shoulder receiving the corresponding detent formed on the mounting base of said shunting switch.

11. A connector as defined in claim 9 further characterized in that each of said first and second contacting parts being moveable laterally along lateral side edges of the connecting pin associated with it to cause wiping.

12. A connector as defined in claim 11 further characterized in that each of said contact edges extends laterally of the at least one shunting switch; and wherein the pair of contacting pins associated with said at least one shunting switch are spaced apart by a distance which is smaller than the spacing between the contact edges of the first and second contacting parts when the parts are in a relaxed condition.

13. An electrical connector comprising:

a housing having a base with opposed upstanding sidewalls defining opposing side faces defining a receptacle therein:

a plurality of contact pins arranged on said base such that a pair of said contact pins define surfaces which oppose one another, at least some of said contact pins being arranged in a row at regular spacing;

at least one shunting switch associated with a pair of said contact pins in said row;

said at least one shunting switch being bifurcated to define two contact surfaces each respectively disposed along lateral sides of said switch and contacting one of said contact pin opposing surfaces and being laterally deflectable upon engagement with said opposing surfaces.

14. A connector as defined in claim 13 wherein said contact surfaces are formed respectively on first and second contact parts, said first and second contact parts being bifurcated by a generally V-shaped slot opening laterally outwardly toward a free end of the shunting switch which is associated with the contact pins.

15. A connector as defined in claim 14 wherein said at least one shunting switch includes a major portion and a minor portion with said major portion including a mounting base and a body integrally connected with one another.

16. A connector as defined in claim 15 wherein said mounting base having a first given width and said body having a second given width so as to create a shoulder between the body and the mounting base of said connector.

17. A connector as defined in claim 16 further characterized in that said V-shaped slot creates said first and second contact parts in said connector; and wherein each of said first and second contacting parts including a bent contact surface bent out of the plane which includes the remaining length of said first and second contact parts.

18. A connector as defined in claim 17 further characterized in that said first and second contacting parts make up the minor portion of said at least one shunting switch and said mounting base and said elongated body make up the major portion of said at least one shunting switch and each of said major and minor portions being integrally connected to one another by a U-shaped interconnecting portion.

19. A connector as defined in claim 18 further characterized in that said first and second contacting parts defining a free end of said at least one shunting switch and ending at a first distance therefrom and being disposed at given angle when said major and minor portions are in a relaxed condition.

20. A connector as defined in claim 19 wherein said at least one shunting switch is mounted to said housing at a second given distance measured to the row of contact pins, and which second given distance being less than said first given distance.

* * * * *